US009030133B2

(12) United States Patent
Hartwig

(10) Patent No.: US 9,030,133 B2
(45) Date of Patent: May 12, 2015

(54) METHOD FOR OPERATING HIGH-PRESSURE DISCHARGE LAMPS

(75) Inventor: Ulrich Hartwig, Berlin (DE)

(73) Assignee: Osram GmbH, Munich ( * ) Notice: Subject to any disclaimer, the term of this patent is extended or adjusted under 35 U.S.C. 154(b) by 210 days.

(21) Appl. No.: 13/499,912

(22) PCT Filed: Aug. 25, 2010

(86) PCT No.: PCT/EP2010/062372
§ 371 (c)(1),
(2), (4) Date: Apr. 3, 2012

(87) PCT Pub. No.: WO2011/042250
PCT Pub. Date: Apr. 14, 2011

(65) Prior Publication Data
US 2012/0194084 A1 Aug. 2, 2012

(30) Foreign Application Priority Data
Oct. 9, 2009 (DE) ..... 10 2009 048 831

(51) Int. Cl.
*H05B 41/00* (2006.01)
*H05B 41/392* (2006.01)

(52) U.S. Cl.
CPC ..... *H05B 41/3921* (2013.01)

(58) Field of Classification Search
CPC ..... G05B 41/048; G01N 21/39; G03B 21/20; H01J 61/40; H05B 41/36
USPC ..... 315/324, 153, 154, 325, 30, 307, 313, 315/112, 641, 638, 326, 312, DIG. 3
See application file for complete search history.

(56) References Cited

U.S. PATENT DOCUMENTS

| | | | | |
|---|---|---|---|---|
| 4,065,688 | A * | 12/1977 | Thornton | 313/25 |
| 5,015,924 | A | 5/1991 | Berman et al. | |
| 6,051,927 | A | 4/2000 | Graser et al. | |
| 6,114,816 | A | 9/2000 | Nuckolls et al. | |
| 8,042,953 | B2 * | 10/2011 | Takezawa | 353/85 |
| 2005/0024602 | A1 * | 2/2005 | Shimaoka et al. | 353/94 |
| 2005/0040774 | A1 * | 2/2005 | Mueller et al. | 315/291 |
| 2007/0211463 | A1 * | 9/2007 | Chevalier et al. | 362/249 |
| 2008/0185950 | A1 * | 8/2008 | Claus et al. | 313/267 |

(Continued)

FOREIGN PATENT DOCUMENTS

| | | | |
|---|---|---|---|
| CN | 101206463 | A | 6/2008 |
| CN | 101281127 | A | 10/2008 |

(Continued)

OTHER PUBLICATIONS

English language abstract of DE 10145648 B4.
Martin, A. et al.; "Comparison of the emission of a high pressure na lamp working at 50 Hz and at high frequency"; Industry Applications Conference, 2004. 39th IAS Annual Meeting. Conference Record of the 2004 IEEE Seattle, WA, USA; Oct. 3-7, 2004, Piscataway, NJ, USA, IEEE, vol. 3, Oct. 3, 2004; pp. 1660-1666.

(Continued)

*Primary Examiner* — Douglas W Owens
*Assistant Examiner* — Jianzi Chen

(57) ABSTRACT

In various embodiments, a method for operating high-pressure discharge lamps, in which high-pressure discharge lamps are operated at the same time in a different thermodynamic state, so that one high-pressure discharge lamp having an emission line emits at a spectral position and at the same time a different high-pressure discharge lamp having an absorption line emits light at the same spectral position, wherein at least some of the light emitted by each high-pressure discharge lamp is converged in a local area.

13 Claims, 7 Drawing Sheets

(56) References Cited

U.S. PATENT DOCUMENTS

| | | | | |
|---|---|---|---|---|
| 2008/0315786 | A1* | 12/2008 | Weichmann et al. | 315/291 |
| 2009/0016064 | A1* | 1/2009 | Moench et al. | 362/296 |
| 2009/0213336 | A1* | 8/2009 | Takezawa | 353/30 |
| 2009/0302784 | A1* | 12/2009 | Franke et al. | 315/307 |
| 2011/0194290 | A1* | 8/2011 | Hartwig et al. | 362/296.01 |
| 2013/0147400 | A1* | 6/2013 | Van Herpen et al. | 315/313 |

FOREIGN PATENT DOCUMENTS

| | | | |
|---|---|---|---|
| DE | 9100816 | U1 | 4/1991 |
| DE | 10145648 | B4 | 8/2006 |
| WO | 2008072154 | A2 | 6/2008 |

OTHER PUBLICATIONS

Paksy, L. et al.; "Effect of axial injection of argon on conventional spectrochemical excitation sources at atmospheric pressure—I"; Spectrochimica ACTA. Part B: Atomic Spectroscopy, New York, NY, US; vol. 38, No. 8, Jan. 1, 1983; pp. 1099-1114.

Winefordner, J. D. et al; "Intensity of thermal radiation of metal spectra in flame emission spectrometry"; Analytica Chimica ACTA, Elsevier, Amsterdam, NL; vol. 36, Jan. 1, 1966; pp. 25-41.

Chinese Office Action of corresponding application No. 201080045514.9, mailed Nov. 13, 2013.

* cited by examiner

METHOD FOR OPERATING HIGH-PRESSURE DISCHARGE LAMPS

RELATED APPLICATIONS

The present application is a national stage entry according to 35 U.S.C. §371 of PCT application No. PCT/EP2010/062372 filed on Aug. 25, 2010, which claims priority from German Application No. 10 2009 048 831.6, filed on Oct. 9, 2009.

TECHNICAL FIELD

Various embodiments relate to a method for operating at least two high-pressure discharge lamps, with which the spectral distribution is homogenized, and this improves color reproduction by way of example. Various embodiments also relate to a lighting unit which is operated according to the method, and to the use of high-pressure discharge lamps in a manner according to the method.

BACKGROUND

In high-pressure discharge lamps light is generated with a passage of current through a gas or metal vapor plasma in a sealed discharge vessel. Ions, electrons and neutral particles exist side by side in the plasma in the basic state and in the excited state, with the electrons absorbing energy in the electrical field and transmitting the discharge to the atoms or molecules by way of an impact. Atoms or molecules are excited in the process and the energy released during the return to the basic state is emitted as radiation characteristic of the relevant atom or molecule. These typically pressure-broadened emission lines are particularly disadvantageous in applications which require exact color reproduction or a complete spectrum, as, by way of example, a Planck radiator exhibits.

SUMMARY

Various embodiments disclose a method for operating high-pressure discharge lamps which improves the spectral distribution.

According to various embodiments, at least two high-pressure discharge lamps are operated at the same times in a different thermodynamic state, so that one high-pressure discharge lamp emits light with an emission line at a spectral position and at the same time a different high-pressure discharge lamp emits light with an absorption line at the same spectral position. The high-pressure discharge lamps are arranged in such a way, or their light is guided in such a way, that at least some of the light emitted by each high-pressure discharge lamp is converged in a local area.

In this connection light denotes not only the range of the electromagnetic wave spectrum visible to humans, but also refers within the meaning of the physical use of the term to the entire electromagnetic wave spectrum, in other words includes the UV and infrared ranges in particular in addition to the visible range.

In the local area in which the light of the high-pressure discharge lamps is converged, the irradiance is produced as a sum of those values which would exist during operation of just one high-pressure discharge lamp respectively. In the following this is called summation (of the irradiance or beam power). The irradiance reflects the incident beam power per area, i.e. the radiation intensity, and will be used in the following where the beam power refers to a specific area (by way of example the area of a measuring sensor). In the visible range of the spectrum the irradiance is also called the illuminance.

The term 'high-pressure discharge lamp' will also be abbreviated to 'lamp' hereinafter (high-pressure discharge lamp designates a lamp whose pressure during operation is between, increasingly preferred in this sequence: 10, 15 and 25 bar and increasingly preferred in this sequence: 400, 350 and 300 bar).

In various embodiments the spectrum of each individual lamp at the spectral position of the line has a beam power which is significantly increased (emission line) or decreased (absorption line) with respect to the continuous fraction of the spectrum. By way of the summation there is therefore an at least partial equalizing of the beam power, so that the difference in the spectral position of the line from the continuous fraction of the spectrum is lower. This applies at least with reference to a spectral range about the line and not necessarily in relation to the entire spectrum, as even the continuous fraction of the spectrum can exhibit a changing beam power. It is crucial, however, that the singular variation in the beam power is reduced in the region of the line, the curve characteristic is smoothed and therewith the homogeneity of the spectrum improved. This improved homogeneity leads to improved color reproduction in the visible range of the spectrum, it being possible to optimize this selectively in the red, yellow, green or blue color ranges as well. Selective color reproduction in the red range is described by way of example by the color reproduction indices R9 and R13.

When applying the method use is made of the fact that the spectral position of a line is determined by the lamp filling, although the manifestation as an absorption or emission line can be flexibly adjusted by the design and operating conditions of the lamp. During normal operation of a lamp light is emitted with emission lines, whereas the emission of light with absorption lines (line version) always occurs in a thermodynamic state with a comparatively elevated plasma temperature or an increased operating pressure. The line version follows from a resonant reabsorption of the emitted radiation which is also called characteristic self-absorption and is superimposed on a more or less continuous spectrum. The emission lines can also be superimposed on a more or less continuous spectrum but this is not necessarily the case.

According to various embodiments at least two lamps are provided which are operated at the same times in a different thermodynamic state. The thermodynamic state generally relates in this connection to the temperature, pressure and density distribution in the discharge vessel and can be influenced by the filling of the discharge vessel, the operating current, cooling conditions and bulb or electrode variations. As a function of time a lamp can on the one hand then be operated continuously at an increased plasma temperature or increased operating pressure, so that it emits the light with the absorption line; the light with the emission line is emitted by the other lamp. On the other hand it is also possible, however, for a lamp to alternately emit light with the emission line and light with the absorption line, with this then taking place in a temporally staggered manner with respect to the other lamp, which is also operated in a pulsed manner. A detailed description of these two procedures can be found in the description of dependent claims 2 and 3.

Irrespective of whether the lamps are operated in a pulsed or continuous manner, the light converged in the local area is generated at different plasma temperatures or operating pressures. Light with an emission line and light with an absorption line is therefore converged to equalize the intensity. The beam power is particularly preferably equalized continuously as a function of time. Time intervals are also possible, however, so that light with the emission line and light with the absorption line is simultaneously available for equalizing the beam power for, increasingly preferred in this sequence, at least: 40%, 60%, 80%, 90% and 95% of the operating time.

The spectral characteristic of the beam power is therefore homogenized for at least some of the time and preferably for the entire time characteristic, and this is advantageous for a large number of applications with high requirements for a homogenous spectrum or good color reproduction or even selective color reproduction, from surgical field illumination and endoscopic applications via projection applications through to illumination in photographs and film shots. In the case of the latter, flicker effects can occur in the case of a temporally inhomogeneous spectral distribution and low shutter speeds even if the frame rate is substantially lower than the frequency of the intensity variations. Even in the case of imaging methods in microscopy, in which, by way of example, additional depth information is evaluated by means of a quickly rotating Nipkow disk artifacts can be avoided by a spectrum that is homogenized as a function of time as well.

Various embodiments are cited in the dependent claims. A detailed distinction will no longer be made hereinafter between the description of the method for operating lamps and the device aspect of the invention; the disclosure should be implicitly understood with respect to both categories.

Various embodiments provide that a first lamp only emits light with the line in emission. The emission can occur continuously or at intervals. The spectrum of this lamp does not exhibit an inversion of emission lines to absorption lines as a function of time. The emission of light with the line in absorption then occurs by way of an additional lamp, wherein this is also possible continuously or at intervals.

To what extent light is emitted with an emission or absorption line can be adjusted by way of example by the specification of different current values for the lamps, so in the case of low currents a spectrum with emission lines exists and in the case of high currents a spectrum with absorption lines. The line version can also be attained by an increase in the pressure in the lamp, however. Numerical values relating to the different modes of operation can be found in dependent claims 5 and 6.

The lamps operated at an elevated plasma temperature or increased pressure can be adapted specifically to this operation, in that, by way of example, the electrodes are optimized for operation with high current by way of dimensioning and choice of material, and the discharge vessel is adapted accordingly.

In a further embodiment it is provided that the first lamp alternately emits light with the line in emission and light with the same line in absorption. For the second lamp it is preferably provided in this connection that it is temporally staggered, particularly preferably intermittently in phase opposition, with respect to the first lamp and likewise alternately emits light with the same line in emission and absorption. The light of the lamps is again converged to equalize the intensity, with each individual lamp accordingly alternately providing light with emission and absorption lines as a function of time. The switching times must be selected so as to be longer than the relaxation times of the plasma in this case, in other words longer than one microsecond.

This method variant is also possible when using a plurality of lamps, in particular three of four lamps. The fraction at which each individual lamp is operated at an elevated plasma temperature or increased pressure can again be reduced over the averaged time. Since the electrodes of each individual lamp are operated for a shorter period at elevated temperature, the electrode burn back can be reduced and the life extended thereby.

The dynamic inversion of the line can preferably be attained in that the level of the lamp current varies between a low value and a high value. In AC operation a sinusoidal or rectangular characteristic may be predefined on which current pulse sequences are superimposed, so that the level again varies between a low value and a high value. The frequency can particularly preferably be selected so as to be constant.

In a further embodiment it is also provided that over the averaged time the second lamp emits light with the line in absorption at the same rate as the first lamp. The lamps are therefore, on average, operated for the same period at an elevated plasma temperature or increased operating pressure. Activation occurs preferably by way of variation between a low current value and a high current value, wherein the fractions of the high current value are identical for the first and second lamps over the averaged time. An application with a plurality of lamps is also possible in this connection, with the high current value then existing at the same rate for all lamps over the averaged time. This method variant is therefore suitable in particular for operation of identical lamps.

In a further embodiment the first lamp is operated with a current density between 0.1 A/mm, preferably 0.5 A/mm, and 2 A/mm, preferably 1 A/mm, and in the process emits light with the emission line. The current intensity is based on the electrode spacing respectively in this case. The second discharge lamp is operated in this embodiment with a current density between 3 A/mm, preferably 8 A/mm, and 40 A/mm, preferably 20 A/mm, and emits light with the absorption line.

In a further embodiment the first lamp is operated at an operating pressure between 10 bar, preferably 25 bar, and 150 bar, preferably 50 bar and emits the light with the emission line. The second lamp is operated at an operating pressure between 175 bar, preferably 200 bar, and 400 bar, preferably 300 bar, and emits the light with the absorption line. The numerical values refer to the pressure in the discharge vessel during operation of the lamps.

In a further embodiment it is provided that the light of a lamp or the light converged in the local area is measured by an optical sensor unit. A section of the spectrum can be measured or a discrete value can be detected at a specific wavelength. The measuring range and/or the measuring points is/are preferably chosen at the spectral position of the line or in its surroundings.

In a further embodiment it is then provided that the measured value output by the sensor unit is passed as an input signal to the control loop which activates a lamp. To optimize the homogeneity of the spectrum a measured value determined in the local area in which the light is converged can therefore be used for control by way of example. The ratio by way of example can then be adjusted from a low current value to a high current value in relation to this control variable to optimize the homogeneity of the spectrum. Control takes places not necessarily for just one lamp but may also be executed for a plurality of lamps. In addition to control by way of adaptation of the current intensity it is also possible to adjust the cooling conditions of a lamp and therewith its operating pressure.

A further embodiment provides that the light of a lamp or the light converged in the local area is changed using an optical filter. If the light of a lamp is changed, regions of the spectrum by way of example can be attenuated with those lines which do not exhibit an inversion, or exhibit only a slight inversion. The intensity of a lamp is therefore adjusted to obtain an optimally smooth characteristic of the entire spectrum after the light has been converged.

Various embodiments related to devices include a lighting unit having lamps which are operated according to one of the described methods. The lamps are assembled in a housing made by way of example from metal or plastics and are arranged in such a way that at least some of the emitted light can be converged using either a common reflector or also one reflector per lamp. Further optical components such as lenses, filters, mirrors, diaphragms and an integrator rod can, moreover, be provided in the same housing and it is also possible to integrate electrical and electronic components which are used to activate and control the lamps.

In a further embodiment it is provided that the lighting unit is a component of a projector. The projector can be designed to display films and transparencies as well as for connection to analog or digital signal sources such as video recorders or computers and to display computer pages and presentations. Owing to the good color reproduction the lighting unit can be used in a spotlight for illumination in the case of film shots and photographs and is also suitable for use in the realm of surgical field illumination, it being possible to use the lighting unit in particular as a light source for an endoscope or boroscope. Combination with digital image transfer, which can take place by way of example by means of CCD chip and is called video endoscopy, is particularly advantageous in this connection. When using an inventive lighting unit as a light source for an absorption spectrometer, the homogeneous spectrum leads to an improved signal-to-noise ratio. This example of use also applies outside of the visible spectrum.

In a further embodiment the lighting unit includes two identical lamps. The lamps are therefore identical in construction and have the same gas filling at, subject to technical variation, identical pressure. Inventive operation therefore occurs solely by way of activation of the lamps, it also being possible to integrate a plurality of identical lamps in the lighting unit. This embodiment simplifies production of the lighting unit in particular since fewer components and different types of replacement parts have to be kept in stock, and this simplifies logistics.

In a further embodiment the lamp is a mercury vapor high-pressure discharge lamp or a sodium vapor high pressure discharge lamp.

BRIEF DESCRIPTION OF THE DRAWINGS

In the drawings, like reference characters generally refer to the same parts throughout different views. The drawings are not necessarily to scale, emphasis instead being generally upon illustrating the principles of the invention. In the following description, various embodiments are described with reference to the following drawings, in which.

DETAILED DESCRIPTION

The following detailed description refers to the accompanying drawings that show, by way of illustration, specific details and embodiments in which the invention may be practiced.

Figure 1:
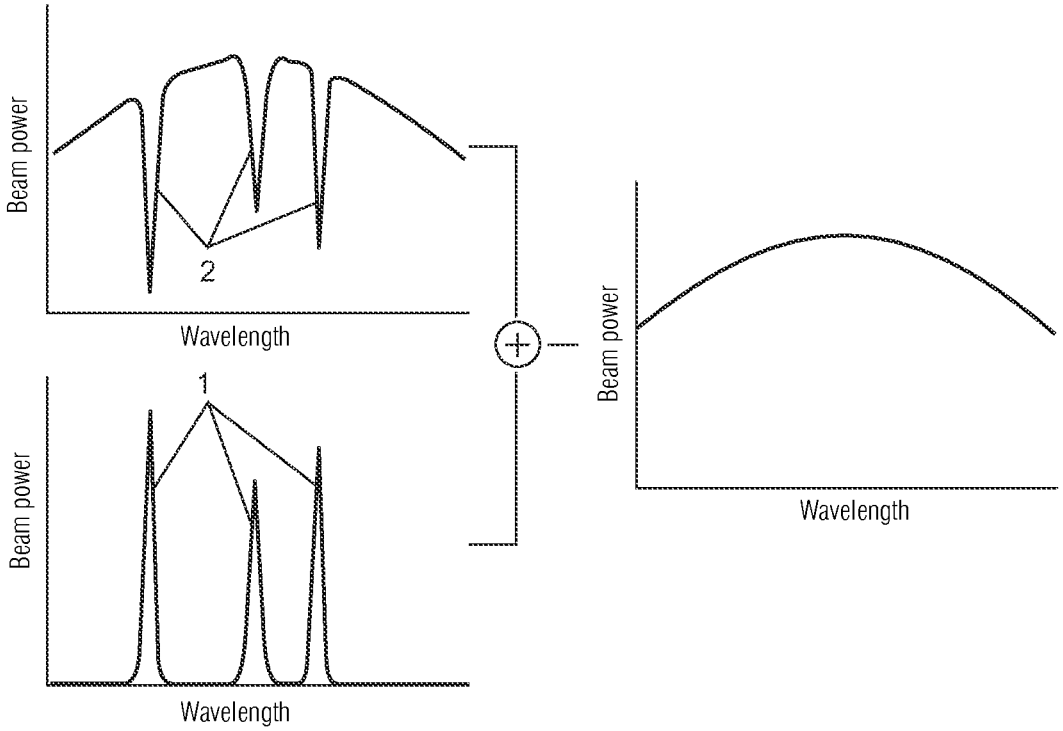
FIG. 1 shows the principle of the method.

FIG. 1 schematically shows a spectrum with emission lines 1 of a first lamp which is operated in a first operating state with an operating pressure $P_1$ and an electrical current $I_1$, and a spectrum with absorption lines 2 of a second lamp which is operated in a second operating state with an operating pressure $P_2>P_1$ and an electrical current $I_2>I_1$. The emission lines 1 and absorption lines 2 lie at the same spectral positions, in other words with the same wavelength values. It should be recognized that the presence of the lines leads to a strong variation in beam power in each individual spectrum. If the light of the two lamps is now converged in a local area there is an equalization in the region of the lines due to the summation of the beam power, and the characteristic of the spectrum is smoothed.

Figure 2:
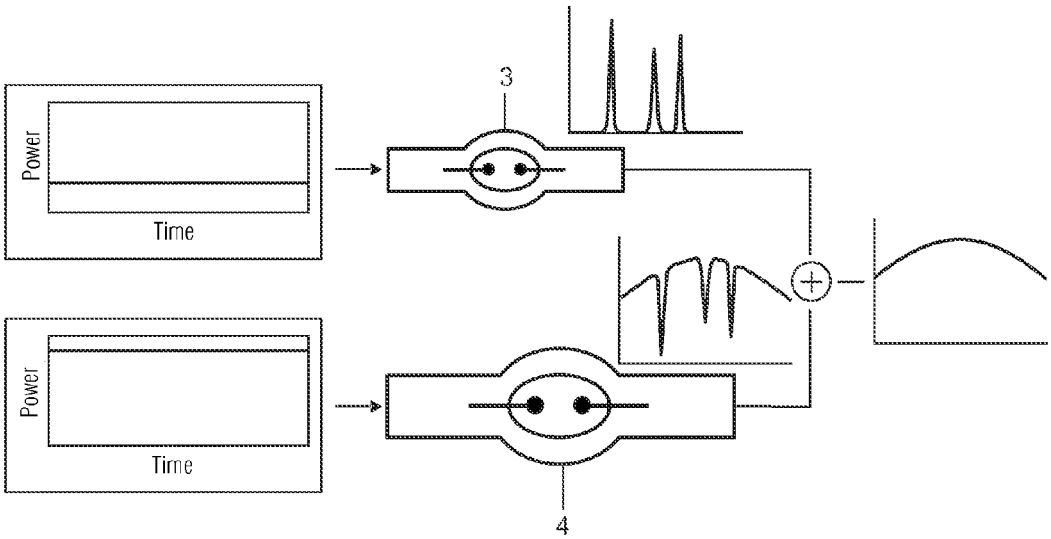
FIG. 2 shows an embodiment with two different lamps.

FIG. 2 schematically shows how this concept can be achieved with two mercury vapor high-pressure discharge lamps 3, 4 which differ in construction and mode of operation, so that the first lamp 3 emits light with emission lines 1 and the second lamp 4 emits light with absorption lines, with both lamps being operated with constant power. Since, aside from pressure, the same filling is present, the lines lie at the same spectral positions, so that a summation of the beam power again leads to a characteristic that is smoothed with respect to each individual spectrum.

Figure 3:
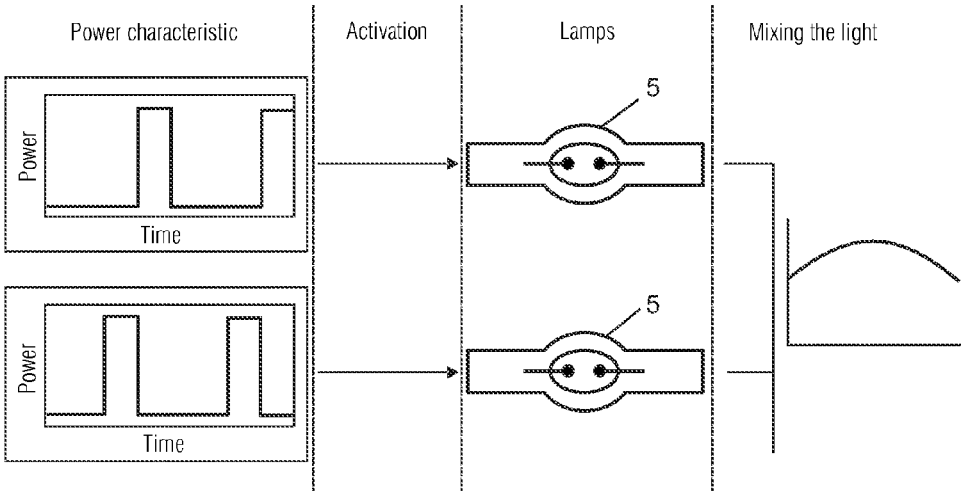
FIG. 3 illustrates the combination of two identical lamps with variable temporal activation.

FIG. 3 schematically shows how in the case of a lighting unit having two identical mercury high-pressure discharge lamps 5 each individual lamp is activated by rectangular pulses, with the lamp current density being varied between 1 A/mm and 14 A/mm. The pulses are temporally staggered, so that one lamp emits light with emission lines 1 while the other lamp emits light with absorption lines 2 and vice versa. By converging the light the beam power is again added up such that the characteristic of the resulting spectrum is smoothed.

Figure 4:
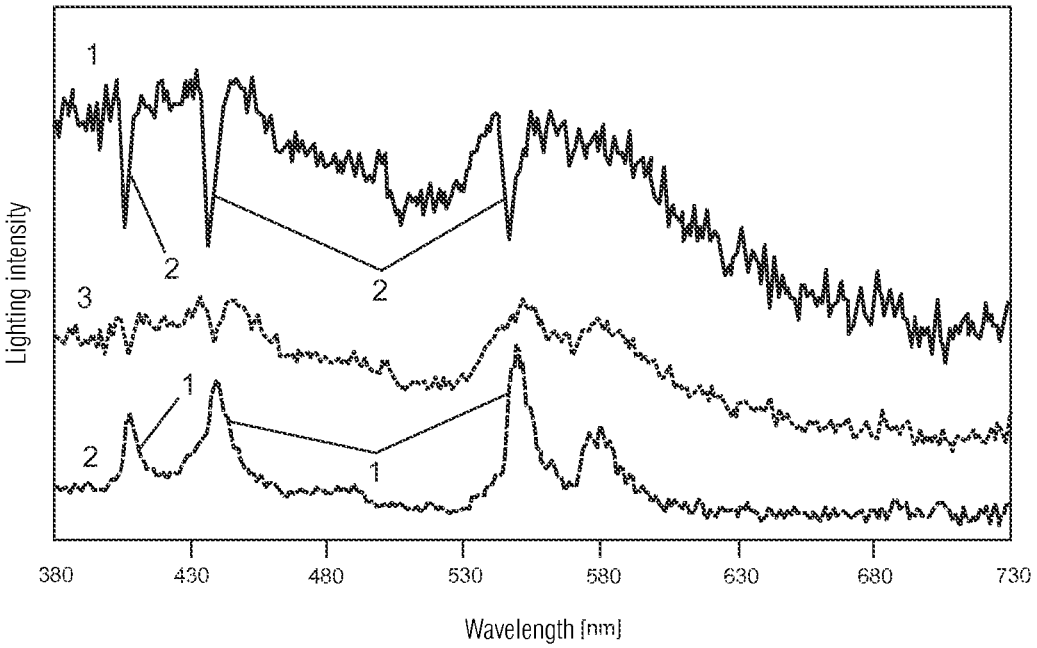
FIG. 4 shows spectra measured for the construction illustrated in FIG. 3.

FIG. 4 shows spectra of two mercury high-pressure discharge lamps 5 measured for a construction according to FIG. 3. The lamp operated with low current emits light with emission lines 1, whereas the lamp operated with high current simultaneously emits light with absorption lines 2. The measured beam power is based on the area of the sensor, so that the irradiance is plotted in the spectra. If a spectrum is now measured in the local area in which the light of the two lamps is converged—in this case equally—then a curve characteristic, which due to the equalizing is smoothed in the region of the lines results (the standardized irradiance and not the absolute irradiance is shown).

Figure 5:
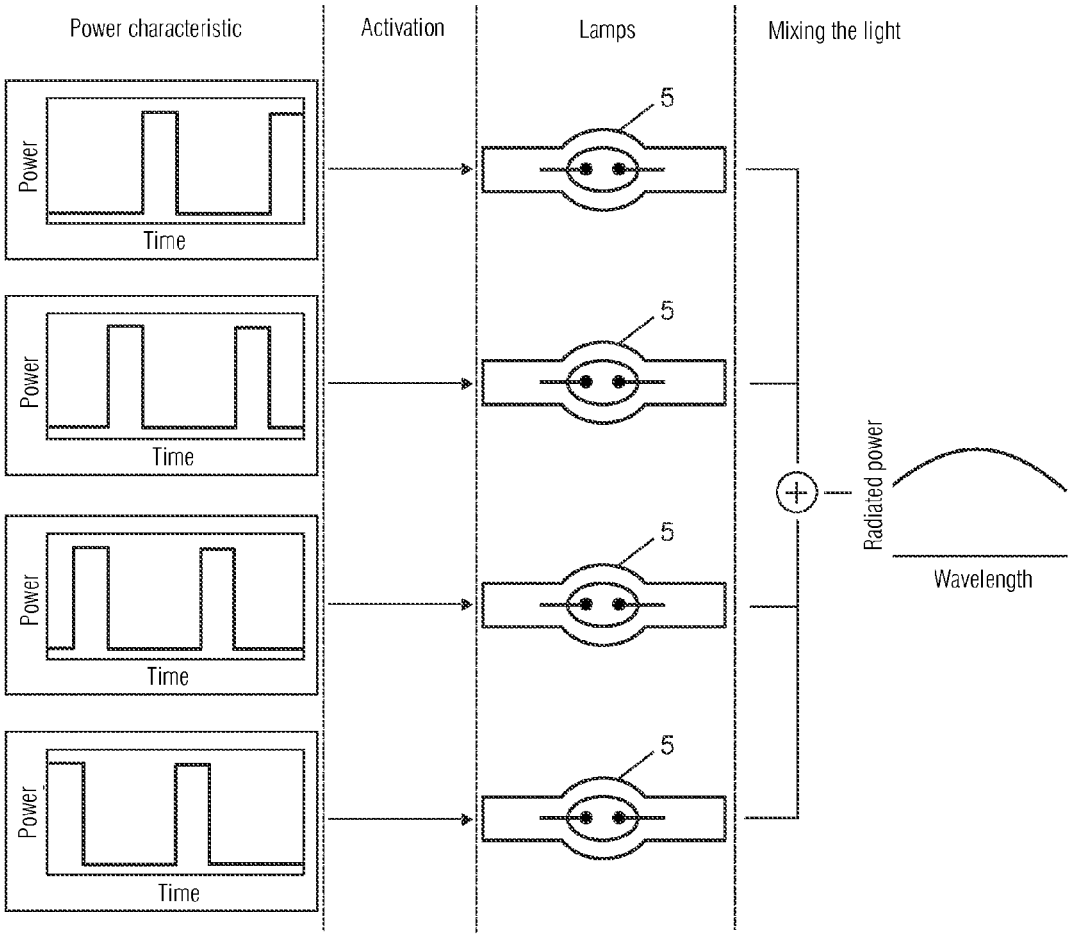
FIG. 5 illustrates the combination of four identical lamps with variable temporal activation.

FIG. 5 shows a lighting unit which conceptually matches the lighting unit shown in FIG. 3 but is expanded by two additional lamps 5. The individual lamps are again activated with pulsed power, these pulses being temporally staggered. The operating state with the high current value, in which light is emitted with the lines in inversion, therefore per mutates from lamp to lamp. However, continuous light with absorption lines 2 is available, so that the emission lines 1 are equalized.

FIG. 6 shows a construction having a first lamp 3 and a second lamp 4, the light of the lamps being guided by reflectors 6 and an optical system 7 to an integrator rod 8. This is a rod made by way of example of glass or quartz and at whose walls there is total reflection, so that a light beam, which enters the rod, is reflected more or less frequently depending on the entry position and angle. This leads to uniform distribution of the light at the exit surface on the one hand and light emitted by each individual lamp being mixed on the other hand.

Figure 6A:
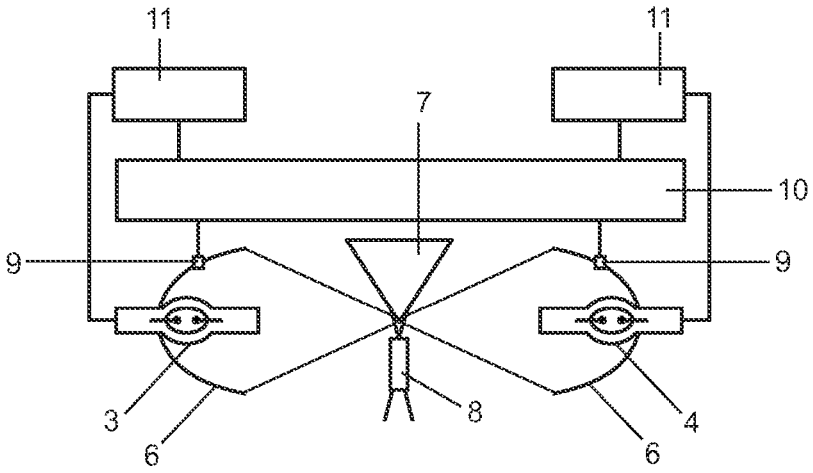
FIG. 6 shows the integration of optical sensors in a construction with two lamps.

FIG. 6A shows an embodiment in which one optical sensor 9 respectively is provided in both reflectors 6 of the discharge lamps 3, 4. The light of each individual lamp is detected by a separate sensor in other words. The two measured values are then passed to a unit 10 for signal processing, wherein the measured values are compared and are controlled in accordance with the electrical ballasts 11 of the two discharge lamps, so that variations, by way of example in the beam power of a lamp, can be equalized by appropriate control of the other lamp.

Figure 6B:
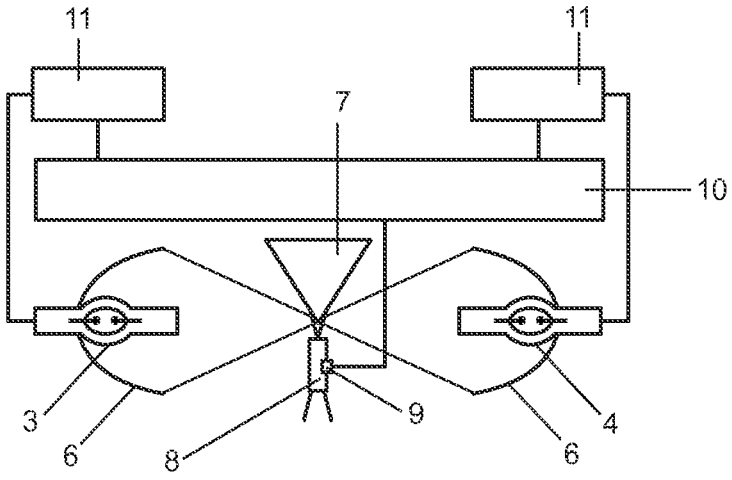

The construction in FIG. 6B matches that in FIG. 6A but instead of two sensors in the two reflectors 6 only one sensor 9 is provided in this case and this is arranged in the integrator rod 8 which therefore detects light after convergence. The measurement is therefore made after the beam power has been equalized, so in this case the homogeneity of the resulting spectrum is the variable that is crucial to signal processing, and the electrical ballasts thereof are controlled accordingly.

FIG. 7 shows a construction having a first lamp 3 and a second lamp 4 whose light is again converged in an integrator rod 8 using two reflectors 6 and a lens system 7.

Figure 7A:
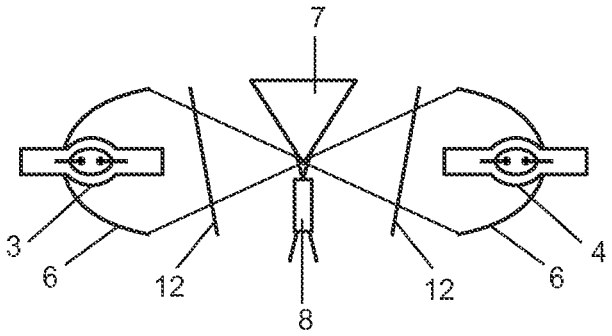
FIG. 7 illustrates the integration of optical filters in a construction having two lamps.

In the example shown in FIG. 7A, before converging, the light of each individual lamp is changed by a filter 12 in such a way that, by way of example, regions of the spectrum in which only a low line version is observed are attenuated. There would be no homogenization of the spectrum in these spectral regions by way of summation of the beam power since only, or at least predominantly, light with lines in emission exists. However, using the filter all regions of the spectrum in which under- or overcompensation of the beam power would otherwise occur can also generally be adapted, so that sufficient homogeneity of the spectrum on the one hand and a beam power adapted to the respective use on the other hand result.

Figure 7B:
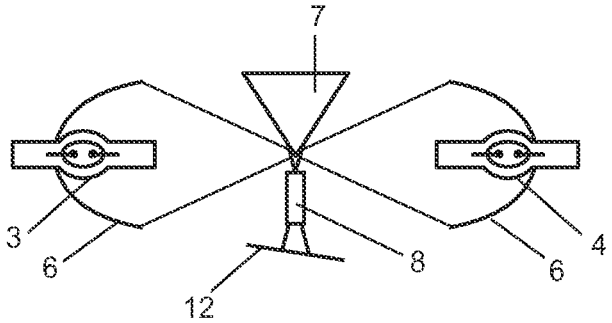

FIG. 7B shows a construction which matches that from FIG. 7A but instead of two filters before convergence of the light, only one filter is provided after convergence of the light. The filter 12 arranged at the outlet of the integrator rod 8 again attenuates regions of the spectrum which differ greatly from the continuous fraction of the spectrum even after converging of the light and summation of the beam power.

Figure 8A:
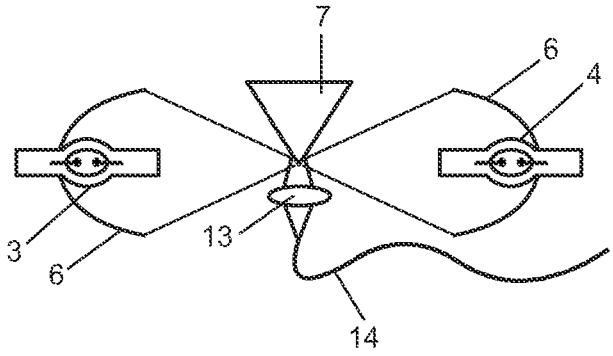
FIG. 8 shows lighting units from different fields of application.

FIG. 8A shows the lighting unit of an endoscope or boroscope in which, after convergence using reflectors 6 and a lens system 7, the light of a first lamp 3 and a second lamp 4 is fed to a further lens system 13 and is coupled by means thereof into a fiber-optic conductor 14. The light with a homogenized spectral characteristic is then introduced via the fiber-optic conductor into the examination or inspection space.

Figure 8B:
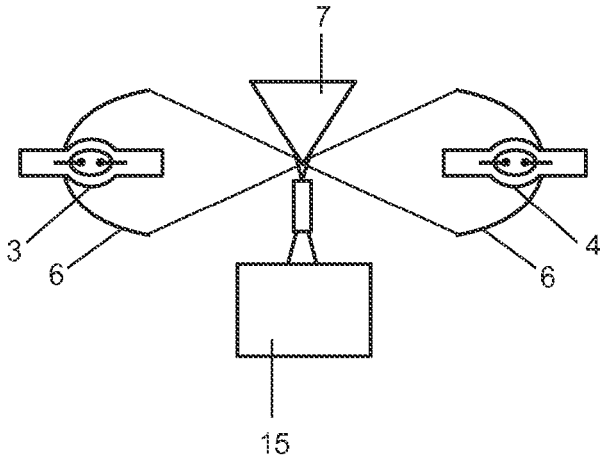

FIG. 8B shows the lighting unit of a projector in which the light of a first lamp 3 and a second lamp 4 is converged in an integrator rod 8 by reflectors 6 and a lens system 7, so that light with a homogenized characteristic is available for projection onto the projection surface 15.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A method for operating high-pressure discharge lamps, wherein high-pressure discharge lamps are operated at the same times in a different thermodynamic state, the method comprising:

a first high-pressure discharge lamp emitting light with an emission line at a spectral position at the same time a second high-pressure discharge lamp emits light with an absorption line at the same spectral position;

wherein at least some of the light emitted by the first high-pressure discharge lamp and at least some of the light emitted by the second high-pressure discharge lamp converge in a local area.

2. The method as claimed in claim 1, wherein the first high-pressure discharge lamp only emits light with the line in emission.

3. The method as claimed in claim 1, wherein the first high-pressure discharge lamp alternately emits light with the line in emission and emits light with the same line in absorption.

4. The method as claimed in claim 3, wherein over the averaged time the second high-pressure discharge lamp emits light with the line in absorption at the same rate as the first high-pressure discharge lamp.

5. The method as claimed in claim 1, wherein the first high-pressure discharge lamp emits light with the emission line at an operating current density between 0.1 A/mm and 2 A/mm, preferably between 0.5 A/mm and 1 A/mm, and the second high-pressure discharge lamp emits light with the absorption line at an operating current density of between 3 A/mm and 40 A/mm, preferably between 8 A/mm and 20 A/mm.

6. The method as claimed in claim 1, wherein the first high-pressure discharge lamp emits light with the emission line at an operating pressure between 10 bar and 150 bar, preferably between 25 bar and 50 bar, and the second discharge lamp emits light with the absorption line at an operating pressure between 175 bar and 400 bar, preferably between 200 bar and 300 bar.

7. The method as claimed in claim 1, wherein the light of at least one high-pressure discharge lamp is detected by an optical sensor unit.

8. The method as claimed in claim 7, wherein a measured value output by the sensor unit is passed as an input signal to a control loop, which control loop activates a high-pressure discharge lamp.

9. The method as claimed in claim 1, wherein the light of at least one high-pressure discharge lamp is changed by an optical filter.

10. A lighting unit comprising:

a plurality of high-pressure discharge lamps, further comprising a first high-pressure discharge lamp in a first thermodynamic state and a second high-pressure discharge lamp in a second thermodynamic state, wherein the first high-pressure discharge lamp emits light with an emission line at a spectral position at the same time the second high-pressure discharge lamp emits light with an absorption line at the same spectral position, the first and second thermodynamics states being different;

wherein the lighting unit causes at least some of the light emitted by the at least the first and the high-pressure discharge lamps to converge in a local area.

11. The lighting unit as claimed in claim 10 for use in a projector, a spotlight or studio light, a surgical field light, an endoscope, a boroscope or an absorption spectrometer.

12. The lighting unit as claimed in claim 10, comprising identical high-pressure discharge lamps.

13. The lighting unit as claimed in claim 10, comprising a mercury vapor high-pressure discharge lamp or sodium vapor high-pressure discharge lamp.

* * * * *